US009791184B2

(12) United States Patent
Novisoff et al.

(10) Patent No.: US 9,791,184 B2
(45) Date of Patent: Oct. 17, 2017

(54) MOBILE THERMOELECTRIC VACCINE COOLER WITH A PLANAR HEAT PIPE

(71) Applicant: Santa Clara University, Santa Clara, CA (US)

(72) Inventors: Paul Novisoff, Los Alamitos, CA (US); Ryne Sitar, Mililani, HI (US); Arturo Nunez Perez, Healdsburg, CA (US); Hohyun Lee, Santa Clara, CA (US); Brandon Ohara, San Jose, CA (US); Joseph Soares, Petaluma, CA (US)

(73) Assignee: Santa Clara University, Santa Clara, CA (US)

( * ) Notice: Subject to any disclaimer, the term of this patent is extended or adjusted under 35 U.S.C. 154(b) by 210 days.

(21) Appl. No.: 14/792,996

(22) Filed: Jul. 7, 2015

(65) Prior Publication Data

US 2016/0003503 A1 Jan. 7, 2016

Related U.S. Application Data

(60) Provisional application No. 62/021,345, filed on Jul. 7, 2014, provisional application No. 62/072,742, filed on Oct. 30, 2014.

(51) Int. Cl.
*F25B 21/02* (2006.01)

(52) U.S. Cl.
CPC ..... *F25B 21/02* (2013.01); *F25B 2321/023* (2013.01); *F25B 2321/025* (2013.01)

(58) Field of Classification Search
CPC ..... F25B 21/02; F25B 2321/025; F25B 2321/023; F25B 21/04
USPC ..... 62/3.2, 3.6; 165/104.26
See application file for complete search history.

(56) References Cited

U.S. PATENT DOCUMENTS

| | | | | |
|---|---|---|---|---|
| 3,713,302 | A | 1/1973 | Reviel | |
| 5,865,032 | A | 2/1999 | MacPherson et al. | |
| 6,880,346 | B1 | 4/2005 | Tseng et al. | |
| 6,935,133 | B2 | 8/2005 | Keeter et al. | |
| 7,861,538 | B2 | 1/2011 | Welle et al. | |
| 2004/0068992 | A1* | 4/2004 | Cauchy | B60N 2/4686 62/3.61 |
| 2012/0036869 | A1* | 2/2012 | Kim | F25B 21/02 62/3.4 |

* cited by examiner

*Primary Examiner* — Davis Hwu
*Assistant Examiner* — Ana Vazquez
(74) *Attorney, Agent, or Firm* — Lumen Patent Firm

(57) ABSTRACT

A portable medical refrigerator is provided that includes a cooling chamber having a housing, insulation and a cavity, where the insulation dissipates heat from the cooling chamber and insulates the cooling chamber, where the insulation includes a material and thickness disposed to hold the cooling chamber at a desired temperature, where the thickness of the insulation is according to an amount of heat entering the cooling chamber from the ambient surroundings, a thermoelectric cooling (TEC) device having a heat sink fan, and a planar heat pipe, where a first end of the planar heat pipe is connected to the cooling chamber and a second end of the planar heat pipe is connected to the TEC, where the TEC is disposed away from the cooling chamber, where the first end of the planar heat pipe is disposed to draw heat from the insulation to enable attainment of the desired temperature.

1 Claim, 6 Drawing Sheets

MOBILE THERMOELECTRIC VACCINE COOLER WITH A PLANAR HEAT PIPE

CROSS-REFERENCE TO RELATED APPLICATIONS

This application claims priority from U.S. Provisional Patent Application 62/021,345 filed Jul. 7, 2014, which is incorporated herein by reference. This application claims priority from U.S. Provisional Patent Application 62/072,742 filed Oct. 30, 2014, which is incorporated herein by reference.

FIELD OF THE INVENTION

The current invention relates generally to medical cooling devices. More particularly, the invention relates to a portable vaccine and insulin cooler.

BACKGROUND OF THE INVENTION

The majority of the world's population suffers from insufficient access to quality health care, partly attributed to the inaccessibility of vaccines in isolated rural areas as well as inconsistent temperature control during the transportation of these vaccines. An exemplary target application is the treatment of Human papillomavirus (HPV), which is a sexually transmitted infection that is currently responsible for 50-60% percent of cervical cancer outbreaks in Ugandan women. This infection causes 3,500 women to be diagnosed with cervical cancer annually in Uganda and 2,400 women die as a result. If preliminary measures are taken, adolescent women from 9-13 years old treated with the HPV vaccine have a 95% chance of preventing the infection. A majority of these adolescent women, as with 86.7% of the Ugandan population, live in rural areas. In these regions, there are limited resources such as a reliable electricity source, so the off-grid transportation of medicines is crucial for maintaining a constant supply chain for vaccines, also known as the cold chain. This concept known as "last-mile distribution" has become a major focus for humanitarian and relief groups, since there is little success in maintaining the efficacy of vaccines during the last stage of transportation.

There are many methods for maintain insulin and other medicines within their required temperature ranges. One very common method utilizes re-freezable ice/gel packs to cool down the designed chamber. The cooling lifetime for these designs is dependent on the length of time that the packs stay frozen and how well the chamber is insulated. While cost is typically low, reliability of the system is an issue. Most other portable medicine cooling devices utilize the temperature difference generated by thermoelectric devices to maintain within a temperature range. However, existing designs cannot reach a temperature difference of 30 K. This makes their effectiveness greatly dependent on outside temperature. An early design used a battery and cooler section joined by thermoelectric material. The electric supply to the thermoelectric device is controlled by a temperature dependent relay. Further advances in controlling temperature utilizes a redundant battery source and the microcontroller power supply strategy take into account the desired temperature range, substance being cooled, and initial battery capacity to maximize battery life. The addition of a low thermal conductivity material, Aerogel, helps to prevent heat leakage into the cooled chamber. With such a high insulation, good heat dissipation is important and has been achieved by designs in various ways. A Thermoelectric Medicine Cooling Bag utilizes a cutaway section for a heat sink to protrude from their design to dissipate heat. One device uses a heat sink to remove heat from the cooled chamber, but in conjunction with a fan to increase the heat sink's heat transfer coefficient. A method for removing heat from the thermoelectric module's hot side is through melting salt has been shown.

What is needed is a mobile vaccine cooler to safely transport and distribute vaccines at their proper storage temperature in developing nations, using thermoelectric modules as a solid-state cooling device.

SUMMARY OF THE INVENTION

To address the needs in the art, a portable medical refrigerator is provided that includes a cooling chamber having a housing, insulation and a cavity, where the insulation is disposed to dissipate heat from the cooling chamber and disposed to insulate the cooling chamber, where the insulation includes a material and thickness disposed to hold the cooling chamber at a desired temperature, where the thickness of the insulation is according to an amount of heat entering the cooling chamber from the ambient surroundings, a thermoelectric cooling (TEC) device having a heat sink fan, and a planar heat pipe, where a first end of the planar heat pipe is connected to the cooling chamber and a second end of the planar heat pipe is connected to the TEC, where the TEC is disposed away from the cooling chamber, where the first end of the planar heat pipe is disposed to draw heat from the insulation of the cooling chamber to enable attainment of the desired temperature.

According to one aspect of the invention, the TEC is displaced from the cooling chamber by a distance that is greater than a thickness of the insulation.

DETAILED DESCRIPTION

Figure 1A:
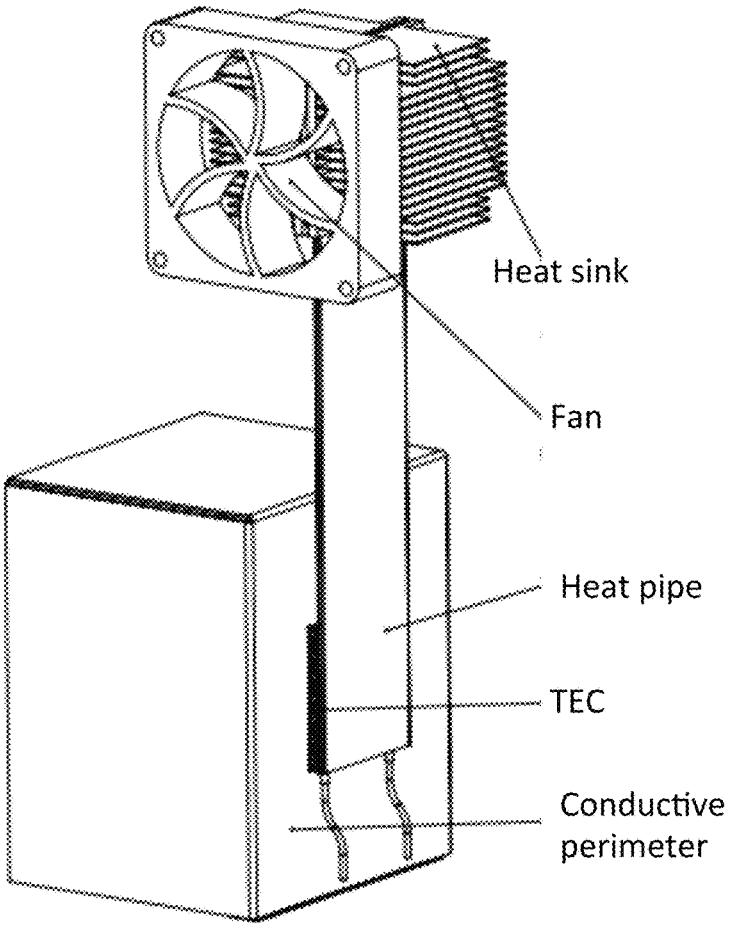
FIGS. 1A-1B show drawings of the overall cooler, according to one embodiment of the invention.

This work provides a mobile vaccine cooler that will be used to safely transport and distribute vaccines at their proper storage temperature in developing nations, using thermoelectric modules as a solid-state cooling device. The mobile vaccine cooler is used for the "last-mile distribution" of the cold chain, or the final stage of the vaccine delivery process, which includes transporting vaccines from regional hospitals to local outreach clinics, where the vaccines are distributed to the patients. The device functions as a mobile refrigeration unit that safely transports and distributes vaccines and insulin at their proper storage temperature, for example 2-8° C., using a single thermoelectric module to provide cooling. When a direct current is supplied to a thermoelectric module (also known as the Peltier effect), it causes one side of the thermoelectric module to become cold, and the other hot. A primary challenge when using thermoelectric modules is to dissipate heat from the hot side in order to maintain cold side temperatures. The mobile vaccine cooler utilizes a planar heat pipe to relocate the heat produced by the thermoelectric module so that the heat can be exhausted at a location outside of the cooler. This thermoelectric module allows the device to be actively cooled, meaning electricity from an external power source is supplied to the module, allowing temperature control within the vaccine compartment. This is in contrast to passively cooled vaccine boxes, which utilize ice packs to keep vaccines cool within the compartment. These passive devices do not allow the user to control and regulate specified temperatures, and cannot maintain proper temperatures once the cooler is opened. An often-overlooked problem with passive vaccine coolers is their tendency to freeze the vaccines when vaccine vials come within close proximity to the ice packs. Freezing causes the vaccines to lose their potency and renders them useless. The actively cooled mobile vaccine cooler addresses this issue of temperature control by using the thermoelectric module to regulate the internal temperature, thus preventing the vaccines from spoiling. Vaccines are valuable goods, especially in third world countries, and therefore it is essential to prevent potency loss due to accidental freezing or heating. Although the device is primarily used for transportation, it can also be used for storage as long as power is available.

According to one embodiment, two concentric containers function as an actively cooled vaccine cooler with polystyrene, or other insulation material, between the containers to provide the cooler with insulation. The cooler is cooled using a single thermoelectric module that is configured to operate off-grid using photovoltaic panels and/or rechargeable batteries. The cooler utilizes a planar heat pipe, external heat sinks, and a low powered fan to dissipate the heat rejected by the thermoelectric module. This heat dissipation system is what makes the mobile vaccine cooler unique and different from technologies known in the art that are being used to transport vaccines during the last mile. An exemplary proof of concept cooler is 1200 ml in volume, and maintains an internal temperature range of 2-8° C. FIGS. 1A-18 show drawings of the overall cooler. The main components of the mobile vaccine cooler are discussed herein. The cooling device is a single thermoelectric module by means of the Peltier effect.

According to one embodiment, the mobile vaccine cooler is cooled by a single thermoelectric module (TEM), which is a solid state device that operates on the principle of the Peltier effect. The Peltier effect states that a temperature gradient is generated whenever a current runs through two dissimilar, conductive materials, such as a TEM. Essentially, one side of the TEM becomes cold, absorbing the heat around it, while the other side of the TEM becomes hot, rejecting the absorbed heat to its surroundings. A commonly used material in thermoelectric modules is bismuth telluride ($Bi_2Te_3$), which can be positively or negatively charged, thereby creating the two dissimilar materials.

The temperature gradient is observed on the ceramic plates on either side of the TEM. This effect allows one side of the TEM to reach a temperature that is lower than the ambient temperature, while the other side reaches a temperature that is higher than the ambient temperature. The actual temperatures of either side of the TEM depend on the current supplied to the TEM along with the ambient temperature. A TEM operating in cool ambient temperatures will have lower temperatures on the cold side than a thermoelectric module operating in warmer ambient temperatures. There are other ways to adjust the performance of TEMs, one of which is by adding a heat sink to either the hot or cold side of the thermoelectric module. Heat sinks improve the heat transfer properties of a system and can create a greater rate of heat transfer between the TEM and the environment. By removing heat from the hot side, a larger temperature gradient can exist across the module, enabling subzero cold side temperatures.

According to a further embodiment, the mobile vaccine cooler utilizes the cold side of the TEM to provide cooling to the vaccine container. When the TEM is not operating, the temperature of the vaccine container is equivalent to the temperature of the ambient environment. In order for the container to cool to suitable temperatures for vaccines and insulin, heat from within the container must be taken out of the container. This is done by attaching the cold side of the TEM to the outside of the vaccine container, as shown in FIG. 1A. Heat flows from higher temperatures to lower temperatures in order to achieve thermal equilibrium. For this reason, the heat from within the vaccine container can be absorbed by the cold side of the TEM, and when the heat is absorbed, the vaccine container is able to be cooled to specific temperatures.

According to one embodiment of the invention, the distance that the TEC is displaced from the cooling chamber is very dependent upon the thickness of the insulation, thus the minimum distance the TEC is displaced is at least equal to the thickness of the insulation, so that the TEC can dissipate the heat outside of the insulation.

Figure 2:
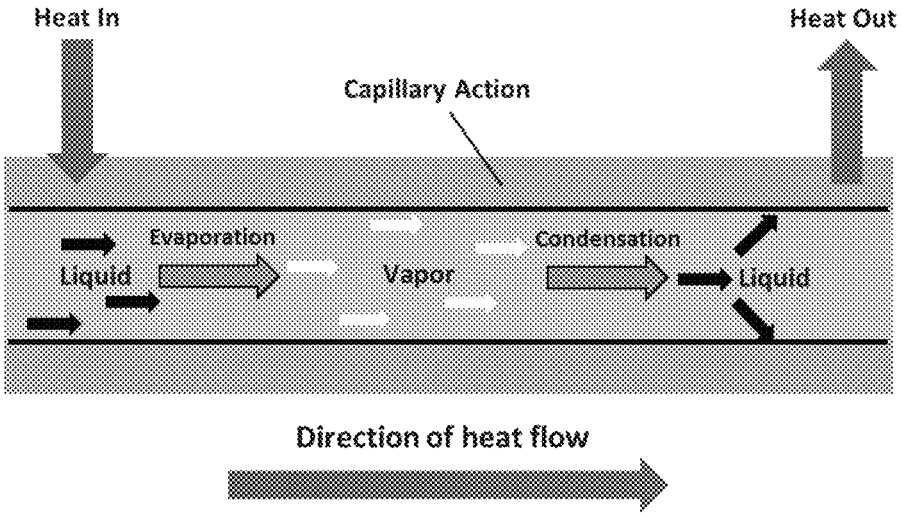
FIG. 2 shows heat pipe operation principles of phase transition of the working fluid (acetone) within the pipe as well as the thermal conductivity of the pipe material, according to one embodiment of the invention.

In a further aspect, the invention includes a planar heat pipe to move heat from one location to another. This is important for the application of a mobile cooler because the heat will need to be expelled at a location away from the insulation and insulated container. A heat pipe operates on the principles of phase transition of the working fluid (acetone) within the pipe as well as the thermal conductivity of the pipe material, as shown in FIG. 2. When heat is applied to one side of a heat pipe, the liquid acetone at that location turns into vapor and travels through the pipe to the opposite, colder side, taking the rejected heat from the TEM with it. As the vapor travels along the heat pipe to the cold side, the heat is rejected at the cold side of the heat pipe, releasing the heat energy into the environment. This energy loss causes the acetone vapor to return to the lower energy state of liquid, at which point the liquid returns to the hot side due to capillary action within the heat pipe, where the cycle repeats itself. Capillary action is the ability of a fluid to travel through narrow spaces, opposing gravitational forces, due to adhesion and cohesion between the fluid particles. Using this method, the rejected heat from the TEM can be quickly extracted to a point outside of the system, and into the environment.

The planar heat pipe can be made from aluminum or other thermally conductive materials such as copper. Further, the dimensions of the heat pipe are also very arbitrary and based on the design and dimensions of the cooling chamber. For example, if a relatively large TEC is used, or more than one TEC are used, a planar heat pipe with a larger size is required.

Figure 3:
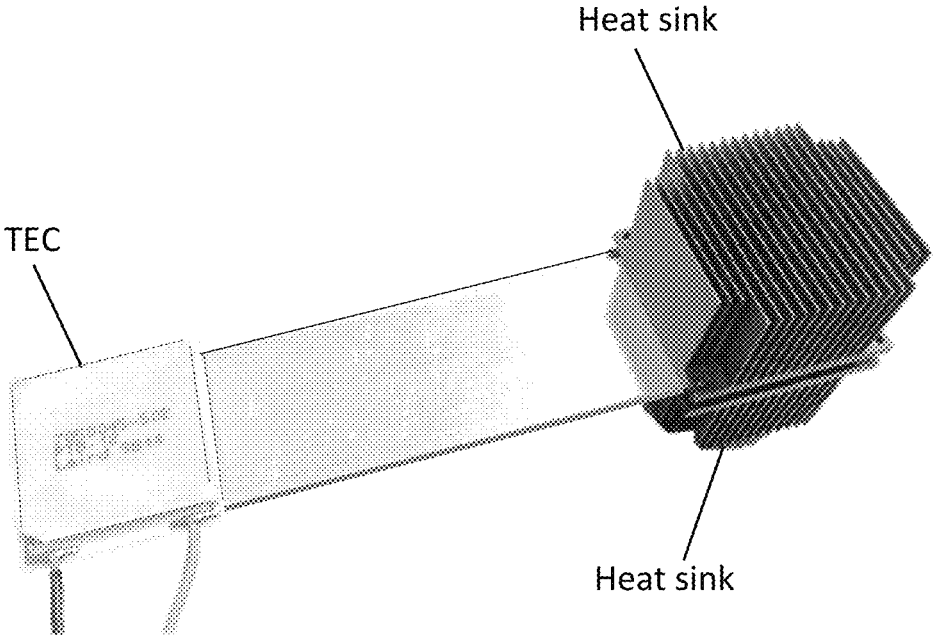
FIG. 3 shows the configuration of the TEM, heat pipe, and two external heat sinks, where the rejected heat from the TEM travels along the heat pipe, and is dissipated at the two external heat sinks, according to one embodiment of the invention.
Figure 4:
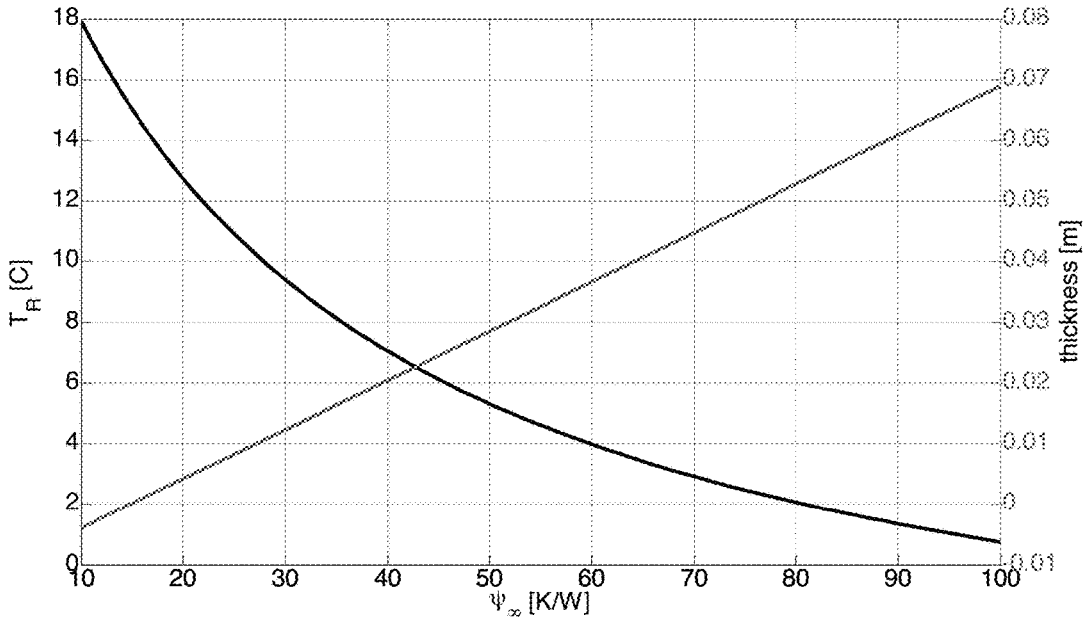
FIG. 4 shows a MATLAB graph of thermal resistance and insulation thickness, according to one embodiment of the invention.
Figure 5:
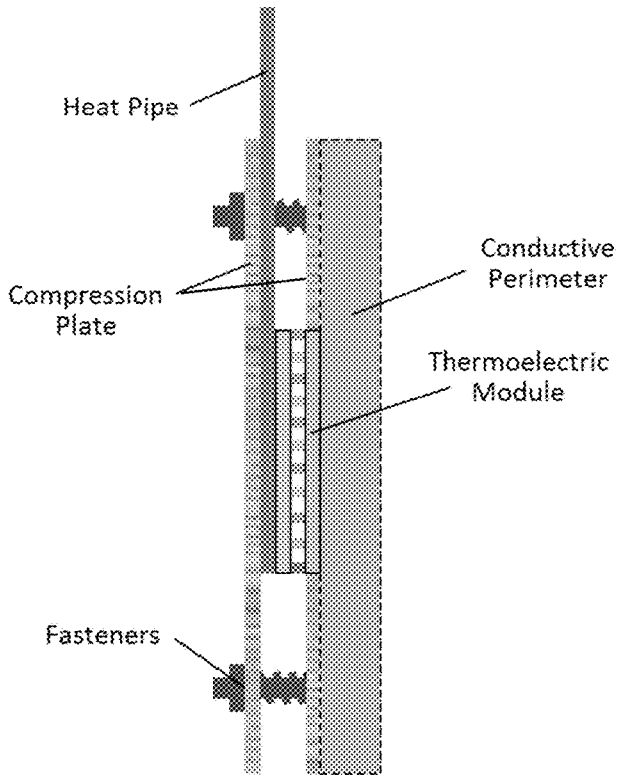
FIG. 5 shows a diagram of the compression plate, according to one embodiment of the invention.

In a further embodiment, for the mobile cooler to reach proper refrigeration temperatures for suitable vaccine transport, the heat pipe is used in conjunction with two heat sinks to dissipate the heat generated by the TEM. The two heat sinks will be positioned at the end opposite of the TEM so that when the heat is transferred away from the TEM, the heat sinks are able to effectively remove the heat from the system to the ambient environment. The TEM, heat pipe, and heat sink configuration is shown in FIG. 3. According to another embodiment, a fan is used to provide forced convection to cool the two external heat sinks. This allows the hot side of the thermoelectric module to stay at relatively cool temperatures, while maintaining the same temperature gradient between the hot and cold side of the thermoelectric module. Here, the cold side of the thermoelectric module is able to reach lower temperatures than if heat sinks and heat pipes were not used.

In a further embodiment, the primary purpose of insulation is to prevent heat from entering the cooler. This is very important especially for passive devices with no power to provide cooling. When a cooler is being used to keep its contents cold, the temperature of the environment is always greater than the temperature inside of the cooler. These two systems (the environment and the cooler) tend to thermal equilibrium with one another by reaching the same temperatures. Because the amount of heat inside the cooler is negligible relative to the environment, the two systems reach thermal equilibrium when the cooler's internal temperatures reach the temperature of the environment. The purpose of all coolers is to resist thermal equilibrium with the environment by insulating the cooler with certain materials to provide a high thermal resistance. The higher the thermal resistance, the longer it takes for two systems to reach thermal equilibrium, and the longer the cooler contents can remain cold.

Active coolers utilize insulation in much the same way as passive coolers. Both types of coolers have insulation to prevent heat from entering the cooler. However, active systems are constantly cooled by the cooling device (in this case, the TEM), and due to the constant power supply, active coolers are able to maintain a constant temperature as long as a power source is provided, unlike passive coolers. In the case of active coolers, the type and amount of insulation affects the amount of heat that enters the cooler, and thus, affects the steady state temperature that the cooler can reach. By using a material with better thermal resistance properties, or by increasing the amount of insulation for the cooler, the thermal resistance of the system increases, and the amount of heat from the environment that enters the cooler per unit time decreases. In effect, the amount of heat that the TEM absorbs becomes much greater than the heat gained by the system from the environment. This allows active coolers to reach colder temperatures with better insulation.

The insulation of an exemplary prototype is polystyrene, or Styrofoam. However, other insulation materials can be used, where inputs determined from calculations where the desired minimum chamber temperature and the overall thermal resistance of the insulation are considered. Using these inputs the best thickness for the insulation is determined.

Turning now to some key aspects of the invention, when a current from a power source is provided to the TEM, one side of the TEM becomes cold and the other side becomes hot. It is important to dissipate the heat from the hot side of the TEM and remove it from the system altogether. Because the entire TEM is enclosed within the system by the insulation, the heat from the hot side of the TEM will remain in the system if there is no heat dissipation system. Without proper heat dissipation, the heat from the hot side of the TEM will remain within the system, and the heat will move back into the vaccine container, and the temperature within the container will increase. Thus, it is necessary to provide the mobile vaccine cooler with a sufficient heat dissipation system in order to remove the heat from the hot side of the TEM.

Many active systems that use a TEM as the cooling device use a fan within the cooler to remove the heat from the hot side of the TEM. With these coolers, the fan is situated inside the cooler directly adjacent to the TEM, and the point of cooling is inside the device. The current mobile vaccine cooler invention utilizes the planar heat pipe in conjunction with the TEM in order to relocate that point of cooling to a point outside of the system, rather than inside of the system. This way, the heat from the TEM is relocated out of the system before the fan is used to help dissipate the heat. Using this method of heat dissipation, the fan does not have to take up space within the cooler. One embodiment is a vertically situated planar heat pipe with two external heat sinks is shown in FIG. 1A. The planar geometry of the heat pipe is also beneficial to the design because insulation can easily fit around the heat pipe. The insulation can have a consistent thickness throughout the cooler because there is no fan for the insulation to be routed around. The hot side of the TEM is attached to one end of the heat pipe.

According to the invention, the fan provides forced convection to the two external heat sinks that are situated outside of the cooler. A housing is placed around the fan and the two external heat sinks in order to focus the airflow over the heat sinks. The rejected heat from the TEM is relocated at the opposite end of the vertically situated planar heat pipe. The two external heat sinks draw the heat from the heat pipe at that point, and the heat is dissipated from the environment. In order to provide the mobile vaccine cooler with lower temperatures within the vaccine compartment, the heat transfer rate out of the system needs to be increased. The mobile cooler is designed to increase the rate of heat transfer by using a fan to provide forced convection, which raises the heat transfer coefficient. The higher the heat transfer coefficient, the higher the heat transfer rate becomes. The housing that is placed around the two external heat sinks and the fan allows the mobile cooler to secure the fan at the proper position, and to funnel the air towards the two external heat sinks, thereby focusing the airflow.

Due to the strenuous heat conditions in which this device operates, it is imperative that vaccines or insulin are well insulated. The type of material and the integration of the insulation are two key features of the first subsystem. The insulation subsystem ultimately helps with maintain the temperature within the vaccine compartment by minimizing heat gain. The vaccines or insulin need to be kept at a specific temperature range of 2-8° C. throughout the "last mile" segment of the cold chain. The insulation also needs to fit within a compartment of a certain thickness that surrounds the vaccine compartment. The exact thickness will depend on the various thermal properties of the insulation choosen, preferably something with a high thermal resistance in order to minimize thickness. Insulation comes in many forms and can range from fiberglass insulation to a vacuum cavity, since heat transfer needs some sort of physical medium. Polystyrene insulation has been found to be the most economical insulation material, providing the most thermal resistance for both its minimal cost and weight. Because it has a low density, conductive heat transfer within the solid material is minimal. The exemplary prototype (as tested) used 5 cm of polystyrene insulation on all sides on the interior container.

Thicker insulation is always preferable, but increases the volume of the system and negatively affects portability. Calculations show that there exists a minimum required thickness, but beyond this value, it is not economically viable to justify more insulation. There will also be a seal for the door of the inside container, preventing any heat gain.

There are two different heat transfer principles present in the system—convective and conductive heat transfer. Combining the two different heat transfers in the system yields the overall thermal resistance value $\psi_c$. The conductive heat transfer is represented by the thickness of the insulation L divided by the thermal conductivity of the insulation k and the cross-sectional area of the insulated wall A. In addition, the convective heat transfer is a function of the heat transfer coefficient h of the ambient air temperature $T_\infty$.

The thermal resistance of the internal compartment is a function of the two different heat transfer principles. Eq. (1) displays the resulting equation. By rearranging Eq. (1), the exact insulation thickness can be found for our system.

$$\Psi_c = \frac{L}{K\Lambda} + \frac{1}{h\Lambda} \tag{1}$$

$$L = k\left(\Lambda\Psi_c - \frac{1}{h}\right) \tag{2}$$

A MATLAB program was used in order to calculate the appropriate amount of insulation. This program takes into consideration the above equation as well as the physical and operating conditions of the thermoelectric module. The program produced a plot in which temperature, along with insulation thickness was plotted against the respective thermal resistance. As a result, the desired temperature produced an exponential relationship with the thermal resistance, while the insulation thickness was linear. Ultimately, the intent is to reach an internal temperature around 5° C. This would ensure that the internal temperature is well under 8° C. The results showed an internal compartment must have a thermal resistance value of 70 K/W. At this thermal resistance, the insulation needs to be 4.5 cm thick. In this example, in order to compensate for the manufacturing errors that occurred during construction, the insulation was 5 centimeters thick.

The experimental thermal resistance of the system was also calculated to compare the accuracy of the MATLAB model. A control test was performed to determine the time constant. Thermocouples were attached to a small glass container with 150 ml of ice inside. The internal compartment was sealed with the insulation, and different temperatures were recorded as the ice melted.

Figure 1B:
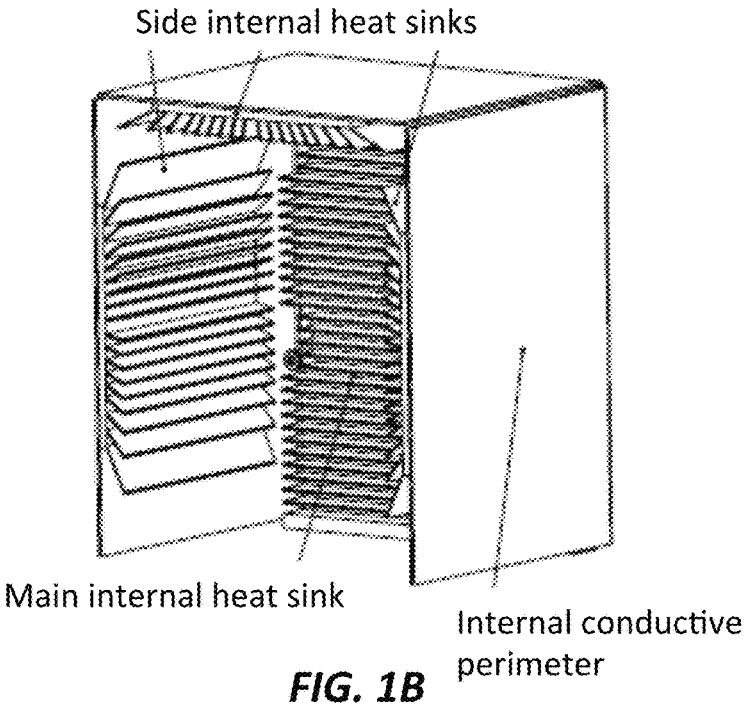

The mobile vaccine or insulin cooler needs to reach comfortable temperatures, for example 2-8° C. for the vaccines. This is done by exposing the cooling chamber (or vaccine compartment) to the cold side of the TEM through the heat pipe. The heat from within the compartment is absorbed by the cold side of the TEM with a certain rate of heat transfer due to convection. In order to increase the convective heat transfer rate from the internal compartment to the cold side of the TEM it is necessary to increase the area exposed to the cold temperatures of the TEM. This is done by attaching a conductive aluminum perimeter measuring ⅛" thick with four aluminum heat sinks to the cold side of the TEM. The conductive perimeter can be formed by bending a T-shaped piece of aluminum into a conductive plate with four flat surfaces to hold one heat sink each, for a total of four heat sinks. The four heat sinks have fins attached to them, which increase surface area exposed to the cooling chamber. The convective heat transfer rate is proportional to the area exposed to the heat within the chamber. The larger the surface area exposed to the vaccine compartment, the greater the rate of heat transfer. The conductive perimeter and the four heat sinks allow the heat from within the vaccine compartment to be absorbed at a greater rate than a cooler without the conductive perimeter or heat sinks. Essentially, lower temperatures are observed by increasing the rate of heat transfer. The conductive perimeter is seen in FIG. 1B. The TEM is attached to the center of the back side of the aluminum perimeter with thermal putty in order to ensure a good contact between the cold side of the TEM and the aluminum perimeter. The center positioning of the TEM ensures an even distribution of heat absorption throughout the entire aluminum perimeter. All conductive surfaces between objects will have a layer of thermal putty to ensure consistent contact between the respective surfaces.

In one embodiment, a conductive aluminum perimeter is used to absorb the heat from within the vaccine compartment also allows heat to transfer back into the compartment because heat transfers both into the system and out of the system. The heat that enters the cooling chamber comes from two primary sources: (1) the environment and (2) the hot side of the TEM. In order to prevent heat from the environment transferring back into the system, polystyrene insulation is provided around the entire vaccine compartment, which provides thermal resistance in order to significantly lower the rate of heat transfer back into the system from the environment. However, there is still another source of heat that can leak back into the system, and this heat comes from the hot side of the TEM, and the polystyrene insulation itself is not sufficient to prevent heat from the TEM from entering the vaccine compartment. In order to address this issue, the mobile vaccine cooler utilizes a non-conductive compartment that separates the conductive aluminum perimeter from the hot side of the TEM. In the exemplary prototype, the non-conductive compartment was constructed out of ⅛" balsa wood, which has a low thermal conductivity. This provides the vaccine compartment with a high thermal resistivity, especially to prevent heat from the TEM from entering back into the vaccine compartment. The wooden compartment was in the shape of a hollow prism that has an open face in order to place and remove vaccines into and out of the compartment. The wooden compartment is formed by assembling five separate pieces of balsa wood in the proper configuration. The back face has a 40 mm by 40 mm cut out at the center of the face in order to fit the dimensions of the TEM. Two grooves are sanded into the back face for the two wires of the TEM. Without these two grooves, the TEM could not securely fit into the 40 mm by 40 mm slot that has been cut out. This cut out on the back face allows the TEM to be attached to the conductive aluminum perimeter to be attached to the TEM while decreasing the rate of heat transfer from the hot side of the TEM to the vaccine compartment.

In the exemplary prototype, the conductive aluminum perimeter, the TEM, and the planar heat pipe are attached to each other with thermal putty. However, the thermal putty bond is not strong enough to hold these components together if the mobile cooler is handled regularly. An additional wall behind the inside container serving as a backing, fastened via screws, will secure the main inside heat sink, conductive perimeter, thermoelectric module, and heat pipe together to ensure complete contact between all surfaces. The mobile vaccine cooler utilizes a compression plate to secure the three components together. Using this method, the mobile vaccine cooler can withstand vibration and regular handling of the cooler. The compression plate itself is made of a non-conductive material in order to prevent significant changes in the heat dissipation system. The mobile cooler currently uses wood as its compression plate. The compression plate secures the heat pipe, TEM, and conductive aluminum perimeter using four fasteners that can be easily tightened or loosened using a screwdriver. The fasteners allow the compression plate to be removed if necessary. A diagram of the compression plate can be seen in FIG. 5.

Figure 6:
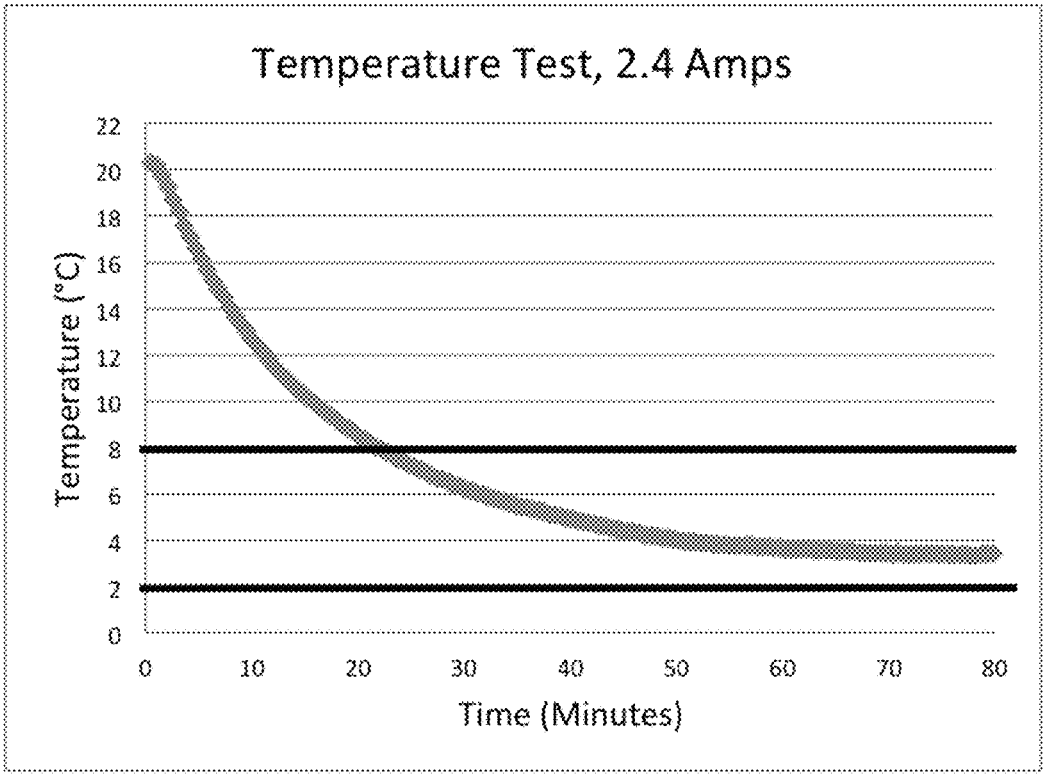
FIG. 6 shows the temperature of the vaccine compartment as a function of time with 2.4 A of current and 5.7 V provided to the TEM, according to one embodiment of the invention.

In the exemplary prototype, the TEM and the fan were connected to separate DC power supplies so that the current supplied to the TEM could vary, while the current supplied to the fan could remain constant. Different values of current were supplied to the TEM during each of the heat dissipation tests. This provided an optimal current value for the TEM to operate at. FIG. 6 shows the temperature of the vaccine compartment as a function of time with 2.4 A of current and 5.7 V provided to the TEM. Using 2.4 A, the mobile vaccine cooler was able to reach the upper bound required temperature of 8° C. in just over 20 minutes. The cooler steadied out at 3.3° C. in just over an hour. This test proved that the TEM could cool the device within the required temperature range of 2-8° C. while using only 13.7 W. The fan that is used to dissipate the heat also consumes 2.4 W, so the total amount of power required for operating the mobile vaccine cooler using this set up was 16.1 W. To put this amount of power into perspective, an average incandescent light bulb operates on 60-100 W.

Figure 7A:
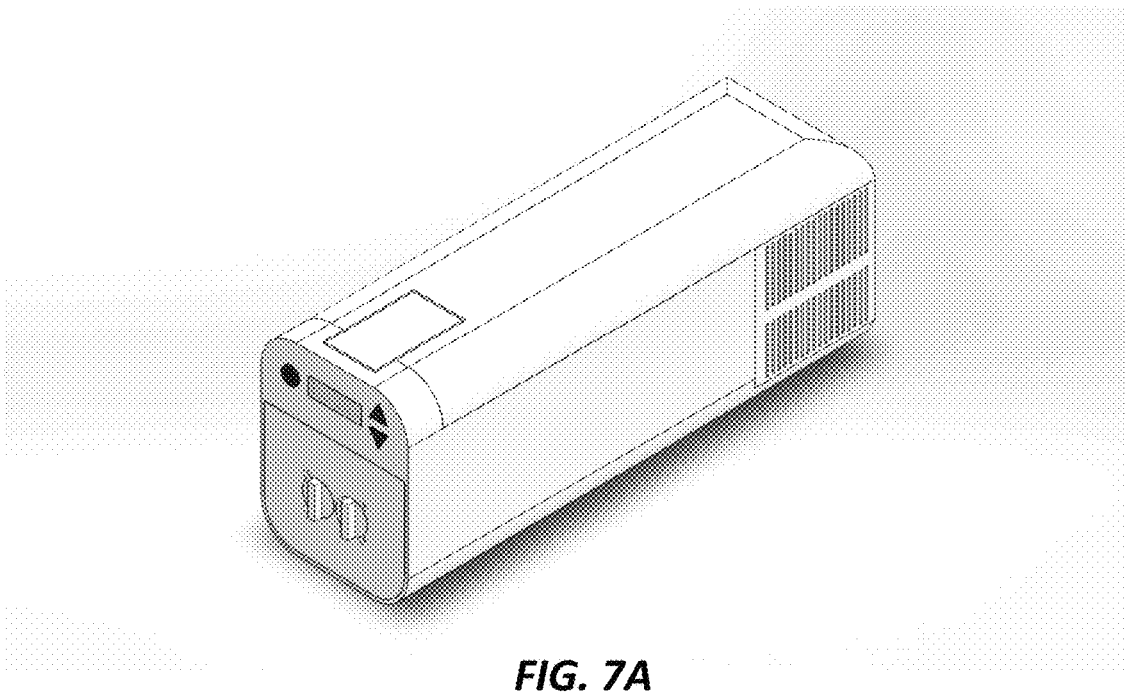
FIGS. 7A-7B show (FIG. 7A) a mobile cooler with two caps for the chambers in front with the controller interface, a battery case located on top, and the fan and heat sinks located in the rear, (FIG. 7B) the thermal dissipation system for the TEC is displayed; pulling heat from the chamber and expelling it through the heat sinks according to one embodiment of the invention.
Figure 7B:
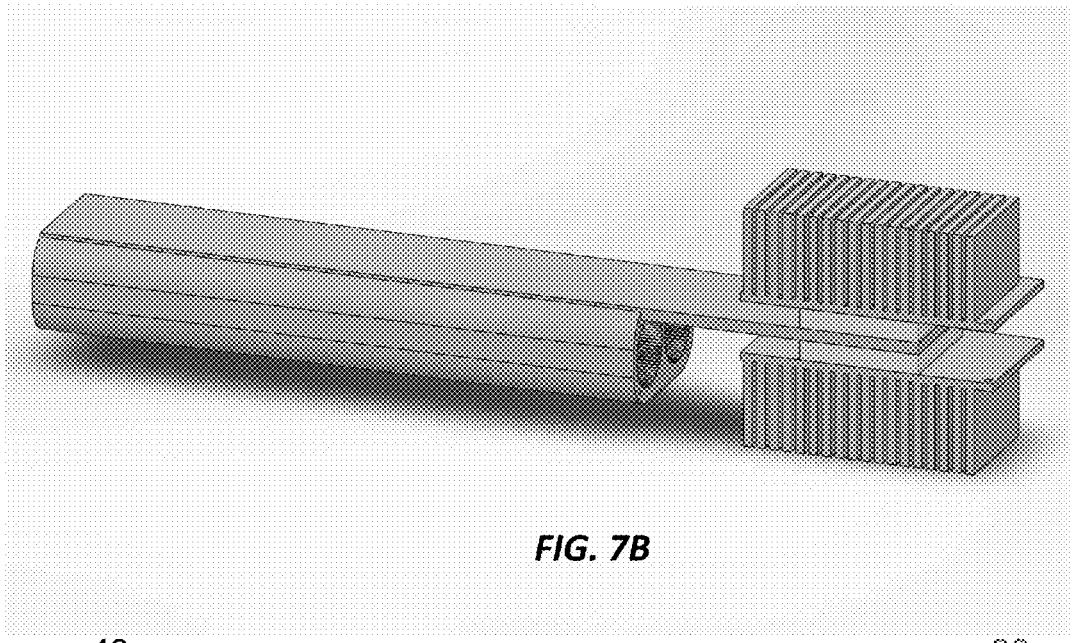
Figure 8:
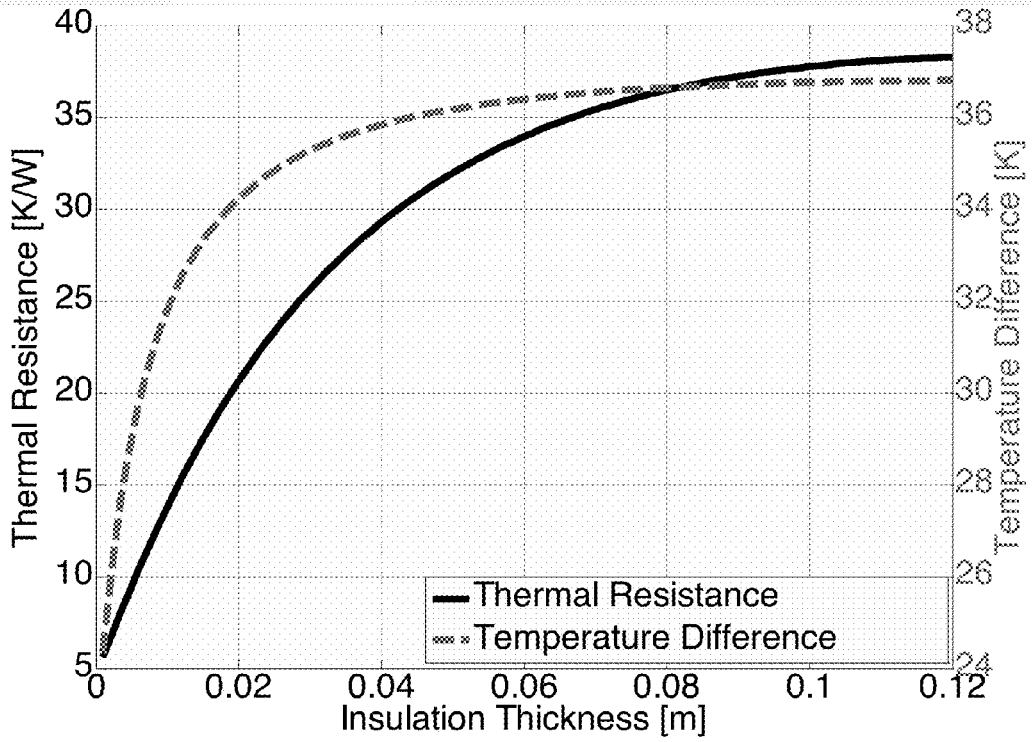
FIG. 8 shows the theoretical values for thermal resistance of the system, when taking into account conductive resistance through the insulation and convective resistance from the outside, according to one embodiment of the invention.

The applications of a small-scale cooling device go beyond delivering medicines for developing nations or emerging markets. Additional variations of this device could be the use for transporting or storing perishables, or other consumables for one's own health as shown in FIGS. 7A-7B. For example the device could be used to hold insulin shots for people with diabetes. This design of the mobile vaccine cooler could potentially serve as the basis for a variety of mobile coolers with different health applications.

In FIGS. 7A-7B the elongated design of the Thermoelectric Cooler (TEC) was decided upon in order to fit two insulin pens. The thermoelectric modules used to cool the chamber are mounted outside the insulation and are linked to the chamber through the use of a heat pipe. The heat pipe, which is mounted along the chamber, allows for energy to be pulled from the chamber to the thermoelectrics. An optimized heat sink is used on each of the thermoelectrics to dissipate heat to the environment by way of forced convection. The insulation surrounding the chamber was selected through an optimization process, taking into account the thermal resistance and weight/volume of the system.

In the exemplary embodiment, the thermoelectric modules were placed outside of the chamber instead of having the cold side in direct contact with the chamber. This was done because it has been determined that the thermal resistance from the hot side of the module to ambient is more critical than the resistance from the chamber to cold side. By placing the modules outside the chamber, the allowable height of the heat sinks was decreased, increasing the hot side thermal resistance slightly. Balancing the two effects was taken into consideration when deciding on the placement of the thermoelectric modules.

Here, polystyrene insulation was decided upon as the material for insulation due to its relatively low thermal conductivity when compared to both its cost and weight. FIG. 2 displays the sum of thermal resistance of conduction through the insulation and the convective resistance from the outside as well as the minimum temperature that was able to be reached within the chamber. The resistances were calculated using a three dimensional conduction shape factor approach. This provides a value, shape factor, for how influential walls, edges, and corners are in the conductive thermal resistance of the system.

For this embodiment, an insulation thickness of 0.02 meters was selected in order to take advantage of the rapidly increasing thermal resistance, while still keeping the overall size of the device small so that it can be easily transported. Just after the selected thickness, the benefits of thicker insulation begin to decrease and minimum temperature does not change too much, therefore increasing size would not be as valuable. As thermal resistance decreases past 20 K/W, the temperature difference only increases by 3 K, proving that an increased weight and volume was not significantly beneficial.

According to the current embodiment, heat sinks are used to increase surface area in order to increase the overall heat transfer from a system, and it is no different for the mobile cooler. By optimizing a heat sink to dissipate as much energy as possible from the hot side of the thermoelectric module, a lower chamber temperature is able to be achieved. The heat sink's physical size is limited by the heat pipe that it is attached to and the dimensions of the fan used to create forced convection. The thermal dissipation system is shown in FIG. 7B.

With a low linear thermal resistance, the heat pipe helps to remove heat from the chamber area to the heat sinks. Within these geometric limits, the overall heat transfer removed from the heat sink was maximized through variations of the fin thickness and pitch. As the fin dimensions vary, so does the number of fins able to be used in the heat sink, changing the overall heat transfer from the heat sink. In order to extract the most heat from the hot side of the thermoelectric module, the thermal resistance through the heat pipe and heat sinks must be kept minimal. This means that the combination of dimensions must be optimized dependent on the fin thickness, pitch, and number of fins for a flow rate past the parallel plate design of approximately 5 m/s. This air velocity was determined through experimental testing. The calculations for thermal resistance treated the parallel plate heat sink design as an external, flat plate, flow and internal, rectangular channel, flow. The two results were averaged in order to account for the closed bottom and open top of the heat sink.

Although there is a minimum point for thermal resistance, it was not selected as the desired design because the weight and cost of the heat sinks applied to the system factor into the decision as well. In order to keep cost and weight down, an overall volume of 6500 $mm^3$ was selected. This resulted in a fin thickness of 0.205 mm and a pitch of 1.205 mm, resulting in a thermal resistance of 0.44 K/W.

In the current embodiment, the chamber in which the insulin is stored is made from an aluminum extrusion process. As the thermoelectric module generates a temperature difference across it, energy is pulled from the extruded aluminum chamber block, lowering its temperature. The chamber was made out of metal, specifically aluminum, due to its ability to conduct heat well and spread evenly throughout the chamber. The low density of aluminum compared to other metals with high thermal conductivity help to minimize the weight of the system. The internal fins in each chamber are included in order to increase the surface area, allowing for a lower thermal resistance between the insulin containers and the aluminum block. By decreasing the thermal resistance, heat transfer is easier between the vacated cavities and the aluminum block and in turn, to the thermoelectric module. Additionally, the fins minimize the amount of direct contact between the walls of the chamber and the insulin to prevent freezing, because the walls are likely to be at lower temperatures than the chamber air. If freezing occurs, the insulin's effectiveness is likely to decrease. The block is designed to be extruded for simple manufacturing and requires addition machining to create a trough in which the heat pipe is mounted.

Figure 9:
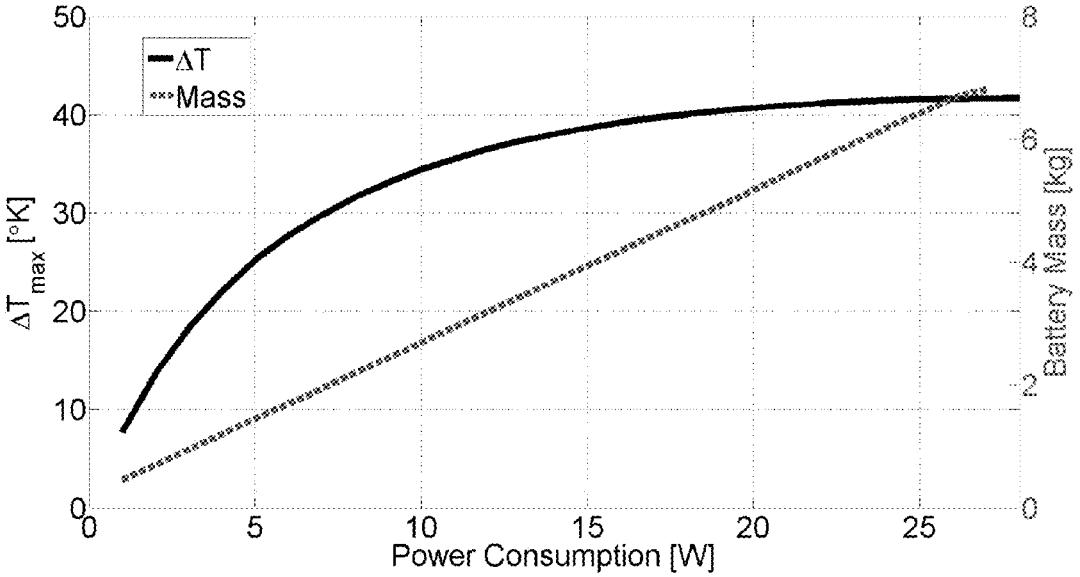
FIG. 9 shows the battery mass and maximum temperature difference between ambient and chamber are plotted as a function of power consumption of the entire system, according to one embodiment of the invention.

The battery pack, top portion of the system, slides into the device and has capacity to operate the cooler for at least 20 hours while supplying 4 amps. This supply of 4 amps will allow for the thermoelectric modules to operate at their ideal current, maximizing heat extracted from the chamber. In addition, minimizing the battery weight and still meeting the 20 hour minimum was important when designing the system to have a low weight. FIG. 9 helps to show how the overall temperature difference required helps to determine the power consumption of the system and battery weight.

There is a dovetail slot in the top of the main body and a latching mechanism locks the battery pack in line and in place. This ensures that the battery remains intact with the system and does not accidentally turn off, making the thermoelectric cooler very reliable and easy to use. The replacement of the battery is important for recharging. The fan and heat sink casing is also removable. Due to the fact that the fan is the only moving part in the system, it is likely the piece of equipment limiting the lifetime of the thermoelectric cooler; therefore accessibility for replacement is important. Accessibility for maintenance and cleaning can also be very important. Depending on the location of usage, dirt and dust accumulating on the fan and heat sinks may limit the effectiveness of the system's heat dissipation. By having access to that area, the heat sinks and fan can easily be cleaned, returning the performance of the system to its initial condition.

In order to generate the greatest temperature difference with the least amount of power, the thermoelectric module geometry must be optimized. The factors that determine the effectiveness of thermoelectric modules are the length of the semiconductor legs and the ratio of filled area to total area, known as the filled factor.

While the temperature of the chamber is controlled by a thermoelectric module, the cooling power of the system can be controlled by switching the electrical power to the thermoelectric on and off. When provided a set temperature range, the interior chamber temperature is monitored and as the temperature approaches the limits, the module is turned on or off to maintain the temperature within the range. For example, when provided a range between 4 degrees Celsius and 8 degrees Celsius, the microcontroller will provide power to the thermoelectric module until the temperature reaches 5 degrees Celsius and then turn off the electrical power supply. As the temperature then reaches 7 degrees Celsius, the module will then be turned on again. By creating a duty cycle, power consumption will be decreased from a traditional system where the module continually operates. In order to customize the set temperature range, the two arrows can be used to modify the range. The ability to do so can help users customize for unique applications and allow for a lower power usage, a wider and higher temperature range.

The slim design on the Thermoelectric Mobile Insulin Cooler allows for many possible variations to its design to increase storage capacity and increase the system's thermal resistance. In order to increase capacity, the extruded aluminum chamber's width can be increased. This slight modification would allow for an additional insulin pen to be carried.

The carrying capacity of the thermoelectric cooler may also be increased to six chambers by connecting two extruded aluminum chambers. By sandwiching the heat pipe between two rectangular aluminum chambers, the design can be further modified. The chambers can be bolted together, creating a good contact with the heat pipe and creating a more square elongated chamber, which has a better thermal resistance per volume than skinny objects. This means that doubling the volume requires less than double the power to maintain the same temperature. The same insulation design and thermal dissipation systems can be utilized for the larger capacity designs due to their similar shape and structure.

While previous variations are to increase capacity while utilizing the same insulation strategy, future designs can apply vacuum insulation to increase thermal resistance while decreasing the overall system size. Due to the fact that vacuum insulation is typically used for cylindrical objects, the mobile cooler can be modified to form a cylinder. By creating a semi-circle with both of the extruded chambers and bolting them together, with the heat pipe in between, a cylinder can be created. This design would allow for an improved volume to surface area ratio, increasing thermal resistance furthermore. This increase in thermal resistance allows for less power to be consumed by the thermoelectric devices, increasing system battery life or allowing for a smaller battery to be used. These possible variations to the system are used for different applications than the small scale Thermoelectric Mobile Insulin Cooler.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example, in order to make this device mobile and off-grid, lithium ion batteries can be integrated into the design. Once the device is sized for batteries, it will allow for portable transportation of the device and the devices' contents.

In another variation, the invention can be housed within a backpack, allowing the cooler to be transported by the user in a convenient and innovative way. For optimal transportation conditions, this backpack can have a rugged shell, able to endure the elements, whether it be heat, rain, foliage, or debris.

In yet another variation, an auxiliary photovoltaic panel can help power the thermoelectric module as well as the cooling fan, allowing the device to operate continuously without a need for batteries, provided that there is enough available energy from the sun. Renewable solar power can also recharge the batteries that otherwise power the device. Maintaining the idea of "off-grid" power is preferable. The form of obtaining solar power can come in multiple forms. If this device were to be carried in a backpack, the surface of the backpack could be layered with solar panels. The possible use of flexible panels would cut down on weight and be able to absorb any incident light that is reflected onto the backpack. This would also allow a compact form for the panels and would shield the device directly. If the device is not directly layered with panels, a standalone panel can be held by the carrier above their head, much like an umbrella, to not only shade themselves, but to also shade the device from the heat of the sun. This optional apparatus can provide a larger surface area for solar power. The addition of solar panels will be configured to a charge converter and inverter, in order to step up or down the proper amperage for the microcontroller. A 12 V adapter can also be fitted to power the device from a vehicle.

According to a further variation, a second thermoelectric module is used, helping to cool the inside container faster, or cool a larger load, whether it be a larger capacity or a constant opening and closing of the device. This would also call for another separate heat dissipation subsystem.

In one variation, a cold pack (unfrozen ice pack) can also rest within the inside container, providing thermal storage, in particular, to keep the inside container cold when the thermoelectric module is powered off or maintain an internal temperature when the device is opened.

According to another variation of the invention, a control system is implemented in order to adjust the temperature within the vaccine compartment. The controller will adjust the amount of current provided by the battery, thus altering the power of the thermoelectric module. This will allow the user to set a designated temperature for the device to operate at.

In yet another embodiment of the invention, a user interface is added, such as a dial or set of buttons control the desired container temperature, since those in the developing world may not know or understand the need to keep vaccines at a controlled temperature. A further addition to the device is a digital readout of remaining battery power as well as instantaneous temperature in the cooler. All such variations are considered to be within the scope and spirit of the present invention as defined by the following claims and their legal equivalents.

What is claimed:

1. A portable medical refrigerator, comprising:

a. a cooling chamber, wherein said cooling chamber comprises a housing, insulation and a cavity, wherein said insulation is disposed to dissipate heat from said cooling chamber and disposed to insulate said cooling chamber, wherein said insulation comprises a material and thickness of said material meet a desired temperature, wherein said thickness of said insulation is according to an amount of heat entering said cooling chamber from the ambient surroundings;

b. a thermoelectric cooling (TEC) device, wherein said TEC comprises a heat sink fan; and c. a planar heat pipe, wherein a first end of said planar heat pipe is connected to said cooling chamber and a second end of said planar heat pipe is connected to said TEC, wherein said TEC is disposed away from said cooling chamber, wherein said first end of said planar heat pipe is disposed to draw heat from said insulation of said cooling chamber to enable attainment of said temperature, wherein said TEC is displaced from said cooling chamber by a distance that is greater than a thickness of said insulation.

* * * * *